US011087966B1

(12) United States Patent
Ding et al.

(10) Patent No.: US 11,087,966 B1
(45) Date of Patent: Aug. 10, 2021

(54) MASS SPECTRUM RESOLUTION DEVICE FOR MEASURING LASER ABLATION ION SPECIES WITH IMPROVED TIME OF FLIGHT MASS SPECTROMETRY

(71) Applicant: DALIAN UNIVERSITY OF TECHNOLOGY, Liaoning (CN)

(72) Inventors: Hongbin Ding, Liaoning (CN); Yuanjie Hao, Liaoning (CN); Ding Wu, Liaoning (CN); Chunlei Feng, Liaoning (CN); Cong Li, Liaoning (CN); Ran Hai, Liaoning (CN)

(73) Assignee: Dalian University of Technology, Liaoning (CN)

( * ) Notice: Subject to any disclaimer, the term of this patent is extended or adjusted under 35 U.S.C. 154(b) by 0 days.

(21) Appl. No.: 17/052,465

(22) PCT Filed: May 26, 2020

(86) PCT No.: PCT/CN2020/092329

§ 371 (c)(1),
(2) Date: Nov. 2, 2020

(87) PCT Pub. No.: WO2020/248812

PCT Pub. Date: Dec. 17, 2020

(30) Foreign Application Priority Data

Jun. 12, 2019 (CN) ..... 201910504585.3

(51) Int. Cl.
*H01J 49/24* (2006.01)
*H01J 49/16* (2006.01)
*H01J 49/40* (2006.01)

(52) U.S. Cl.
CPC ..... *H01J 49/161* (2013.01); *H01J 49/24* (2013.01); *H01J 49/40* (2013.01)

(58) Field of Classification Search
CPC ..... H01J 49/161; H01J 49/24; H01J 49/40
(Continued)

(56) References Cited

U.S. PATENT DOCUMENTS 5,622,567 A * 4/1997 Kojima ..... C23C 14/087 118/726
6,080,586 A * 6/2000 Baldeschwieler ... G01N 1/4022 436/173

(Continued)

FOREIGN PATENT DOCUMENTS

CN 104392887 A 3/2015
CN 206834153 U 1/2018

(Continued)

OTHER PUBLICATIONS

Notification of Grant of the corresponding to Chinese application No. 201910504585.3 dated Mar. 27, 2020 and an English language translation has been provided beginning of the first page is attached. (pp. 2)

(Continued)

*Primary Examiner* — David A Vanore
(74) *Attorney, Agent, or Firm* — Muncy, Geissler, Olds & Lowe, P.C.

(57) ABSTRACT

A mass spectrum resolution device for measuring laser ablation ion species with improved time of flight mass spectrometry includes a vacuum system unit, a plasma production unit, and a particle restraint selection and separation unit, wherein the particle restraint selection and separation unit comprises a particle limit selector and a plurality of ion pulse accelerated electrode plates; the particle limit selector comprises a restrainer lifting block, a restrainer and a restrainer selection baffle; a through hole is formed in the restrainer lifting block; a plurality of circular holes with different apertures are formed in the restrainer selection baffle, and the restrainer and the restrainer selec- (Continued)

tion baffle are arranged in the restrainer lifting block and can move; and the ion pulse accelerated electrode plates are arranged in the advance direction of particles and are axially parallel to the restrainer lifting block.

5 Claims, 2 Drawing Sheets

(58) Field of Classification Search
USPC ..... 250/281, 282, 288, 396 R
See application file for complete search history.

(56) References Cited

U.S. PATENT DOCUMENTS 8,304,720 B2 * 11/2012 Senko ..... H01J 49/423 250/290
8,581,185 B2 * 11/2013 Makarov ..... H01J 49/423 250/292
2003/0025074 A1 * 2/2003 Li ..... H01J 49/40 250/288
2005/0017170 A1 * 1/2005 Schwartz ..... H01J 49/423 250/292
2005/0035285 A1 * 2/2005 Tan ..... H01J 49/164 250/288
2005/0161597 A1 * 7/2005 Guevremont ..... H01J 49/0413 250/294
2006/0289747 A1 * 12/2006 Schultz ..... H01J 49/40 250/294

FOREIGN PATENT DOCUMENTS

CN 207396353 U 5/2018
CN 110176386 A 8/2019

OTHER PUBLICATIONS

Office Action of the corresponding Chinese application No. 201910504585.3 dated Mar. 2, 2020. (pp. 7).

* cited by examiner

MASS SPECTRUM RESOLUTION DEVICE FOR MEASURING LASER ABLATION ION SPECIES WITH IMPROVED TIME OF FLIGHT MASS SPECTROMETRY

TECHNICAL FIELD

The present invention relates to the technical field of mass spectrum analysis, and particularly relates to a mass spectrum resolution device for measuring laser ablation ion species with improved time of flight mass spectrometry.

BACKGROUND

The mass spectrometer technology is one of the hot spots in the current international frontier science and technology development. Since the mass spectrometry involves many disciplines such as physics, chemistry, biology, microelectronics, computer and engineering, and scientific researchers can independently design, assemble and set up mass spectrum experiment systems according to their experimental requirements, the mass spectrometry is always considered one of the most challenging high technologies.

The time of flight mass spectrometry has been used as the measurement and analysis method for the charge-to-mass ratio of charged particles long before, and does not become the prototype of modern commercial time of flight mass spectrometers until Wiley and McLaren complete the design of the mass spectrometer system in 1955. The time of flight mass spectrometry uses the velocity separation of ions with different masses under the action of the same accelerating field in fieldless drift to carry out measurements. Therefore, for plasma, by measuring time of flight mass spectrum data, the types of particles can be detected and the changes in the species of particles during plasma evolution can also be obtained. The time of flight mass spectrometry has high detection sensitivity and is already widely used in the analysis of species distribution. Theoretical and experimental researches show that the mass spectrometry can obtain a full spectrogram within a wide mass range at one time. The combination of the time of flight mass spectrometry and laser ablation plasma can produce the laser ablation time of flight mass spectrum plasma diagnostic technology. Therefore, the time of flight mass spectrometry can be used for off-line diagnosis of the change in the surface composition of the first wall material of the Tokamak magnetic confinement fusion experiment device.

It can be known from the comparison of various diagnostic methods of the first wall material of the Tokamak magnetic confinement fusion experiment device that the time of flight mass spectrometry can obtain the information on all species in plasma produced by laser ablation. The lateral velocity of producing the species by the laser ablation material is an important parameter in the research process. The detection time of particles in the mass spectrum directly corresponds to the mass-to-charge ratios of particles of different species, and the broadening of the mass spectrum peak carries the lateral velocity information of the particles. When the conventional time of flight mass spectrometer measures the species distribution of the plasma plume in vacuum, because the expansion speed is too high, the peak broadening of different species is too large and the discrimination is low, which leads to the low resolution of the time of flight mass spectrometer and thus has an impact on the judgment of species composition. After limitation and selection by the particle limit selector, the lateral velocity of particles in the plasma along the direction perpendicular to the isometric direction becomes lower, which improves the resolution of the time of flight mass spectrometer. The corresponding particle lateral movement velocity can be obtained by reading $t_{min}$ and $t_{max}$ values of the peak by analyzing the broadening of the mass spectrum peak. The rotation time of particles in the time of flight mass spectrum can be calculated by the following formula:

$$\Delta T_{u0}=2u_0/a_1=2|u_0|mM/(ZeU/s)$$

The broadening information of the mass spectrum peak extracted from the mass spectrum data obtained from the experiment is substituted into the above formula to calculate the corresponding initial lateral velocity $u_0$.

In summary, the laser ablation time of flight mass spectrometry can be used to detect the composition of the dust deposit on the first wall of the Tokamak magnetic confinement fusion device, and can also be used to study the composition and velocity distribution and other information of stable species during the expansion of the laser ablation plasma.

SUMMARY

The present invention mainly solves the technical problem of too large broadening during detection of spatial and temporal distribution and initial lateral velocity of different species in samples in the laser ablation time of flight mass spectrometry in the prior art, and provides a mass spectrum resolution device for measuring laser ablation ion species with improved time of flight mass spectrometry, which adopts a particle limit selector that can limit the lateral velocity to limit and select particles with different delays and introduce the particles into the pulse extraction field to apply pulse voltage. When particles accelerated by the electric field move in the fieldless drift zone, different species will separate from each other, and the time difference for reaching the final position is detected, i.e., the composition information and the time evolution distribution of ion species produced by laser ablation samples are obtained. The present invention is suitable for various plasma environments and has strong practicability.

The present invention provides a mass spectrum resolution device for measuring ion species in laser ablation plasma with improved time of flight mass spectrometry, comprising: a vacuum system unit 1, a plasma production unit 2, and a particle restraint selection and separation unit 3, wherein:

The vacuum system unit 1 comprises a vacuum pulse extraction field chamber 11 and a vacuum fieldless drift chamber 12;

The plasma production unit 2 comprises a nanosecond pulse laser 21, a laser reflector 22, a laser focusing lens 23, a sample lifting target 24 and a rotating motor 25; the sample lifting target 24 is arranged on the shaft of the rotating motor 25; the laser generated by the nanosecond pulse laser 21 irradiates a sample placed on the sample lifting target 24 after passing through the laser reflector 22 and the laser focusing lens 23 in sequence; and the laser focusing lens 23 and the sample lifting target 24 are respectively arranged in the vacuum pulse extraction field chamber 11;

The particle restraint selection and separation unit 3 comprises a particle limit selector and a plurality of ion pulse accelerated electrode plates 34; the particle limit selector comprises a restrainer lifting block 31, a restrainer 32 and a restrainer selection baffle 33; a through hole is formed in the restrainer lifting block 31; a plurality of circular holes with different apertures are formed in the restrainer selection baffle 33, and the restrainer 32 and the restrainer selection baffle 33 are both arranged in the restrainer lifting block 31; the restrainer 32 and the restrainer selection baffle 33 can move in the restrainer lifting block 31; the ion pulse accelerated electrode plates 34 are arranged in the advance direction of particles and are axially parallel to the restrainer lifting block 31; the particle limit selector and the ion pulse accelerated electrode plates 34 are respectively arranged in the vacuum pulse extraction field chamber 11; and the particle limit selector is arranged between the two adjacent ion pulse accelerated electrode plates 34 on the utmost front end.

Further, the mass spectrum resolution device for measuring laser ablation ion species with improved time of flight mass spectrometry also comprises a signal collection unit 4;

The signal collection unit 4 comprises a microchannel plate ion detector 41, an oscilloscope 42, a time sequence pulse digital delay generator 43, a computer 44 and a signal transmission line 45;

The microchannel plate ion detector 41 is arranged on the tail end of the vacuum fieldless drift chamber 12; and the microchannel plate ion detector 41 is in signal connection with the oscilloscope 42, and the oscilloscope 42 is respectively in signal connection with the time sequence pulse digital delay generator 43 and the computer 44 through the signal transmission line 45.

Further, a butterfly valve is arranged between the vacuum pulse extraction field chamber 11 and the vacuum fieldless drift chamber 12, and used to control the connection of the vacuum pulse extraction field chamber 11 and the vacuum fieldless drift chamber 12.

Further, the ion pulse accelerated electrode plates 34 are connected with a high voltage pulse module 35.

Further, the number of the ion pulse accelerated electrode plates 34 is four; The first ion pulse accelerated electrode plate is fixed on one side of the restrainer lifting block 31, and the second, third and fourth ion pulse accelerated electrode plates are arranged on the other side of the restrainer lifting block 31 in sequence.

The present invention provides a mass spectrum resolution device for measuring laser ablation ion species with improved time of flight mass spectrometry. The present invention can improve the mass resolution of the time of flight mass spectrum, and research the species distribution and the plasma lateral velocity during the evolution over time of the plasma generated by the interaction between the laser and the material. The particle limit selector that can limit the lateral velocity is adopted to limit the free diffusion of particles in the plasma generated by laser ablation, and can block the plasma in the undesired detection area so that the range of extracted particles is reduced. Compared with the conventional mass spectrometers with other velocity distribution, the device can select the position and range of the extracted plasma according to the experimental requirements, and solve the measurement problem of too large broadening during detection of spatial and temporal distribution and initial lateral velocity of different species in samples in the existing laser ablation time of flight mass spectrometry so that the half-peak width of the spectrum is reduced and the resolution is greatly improved. The data provides experimental data verification for researching the spatial and temporal distribution and the lateral particle velocity measurement of the species during the expansion of the laser ablation plasma, which is conducive to deepening the research on the physical mechanism of the laser ablation process of the plasma, and the plasma introduction range can be selectively controlled, thereby improving the resolution of the time of flight mass spectrum and having a better practical effect.

REFERENCE SIGNS

1. vacuum system unit; 2. plasma production unit; 3. particle restraint selection and separation unit; 4. signal collection unit; 11. stainless steel vacuum pulse extraction field chamber; 12. stainless steel vacuum fieldless drift chamber; 21. nanosecond pulse laser; 22. laser reflector; 23. laser focusing lens; 24. sample lifting target; 25. rotating motor; 31. restrainer lifting block; 32. restrainer; 33. restrainer selection baffle; 34. ion pulse accelerated electrode plate; 35. high voltage pulse module; 41. microchannel plate ion detector; 42. oscilloscope; 43. time sequence pulse digital delay generator; 44. computer; and 45. signal transmission line.

DETAILED DESCRIPTION

To make the technical problem solved, the technical solution adopted and the technical effect achieved by the present invention more clear, the present invention will be further described below in detail in combination with the drawings and the embodiments. It should be understood that the specific embodiments described herein are only used for explaining the present invention, not used for limiting the present invention. In addition, it should be noted that for ease of description, the drawings only show some portions related to the present invention rather than all portions.

Figure 1:
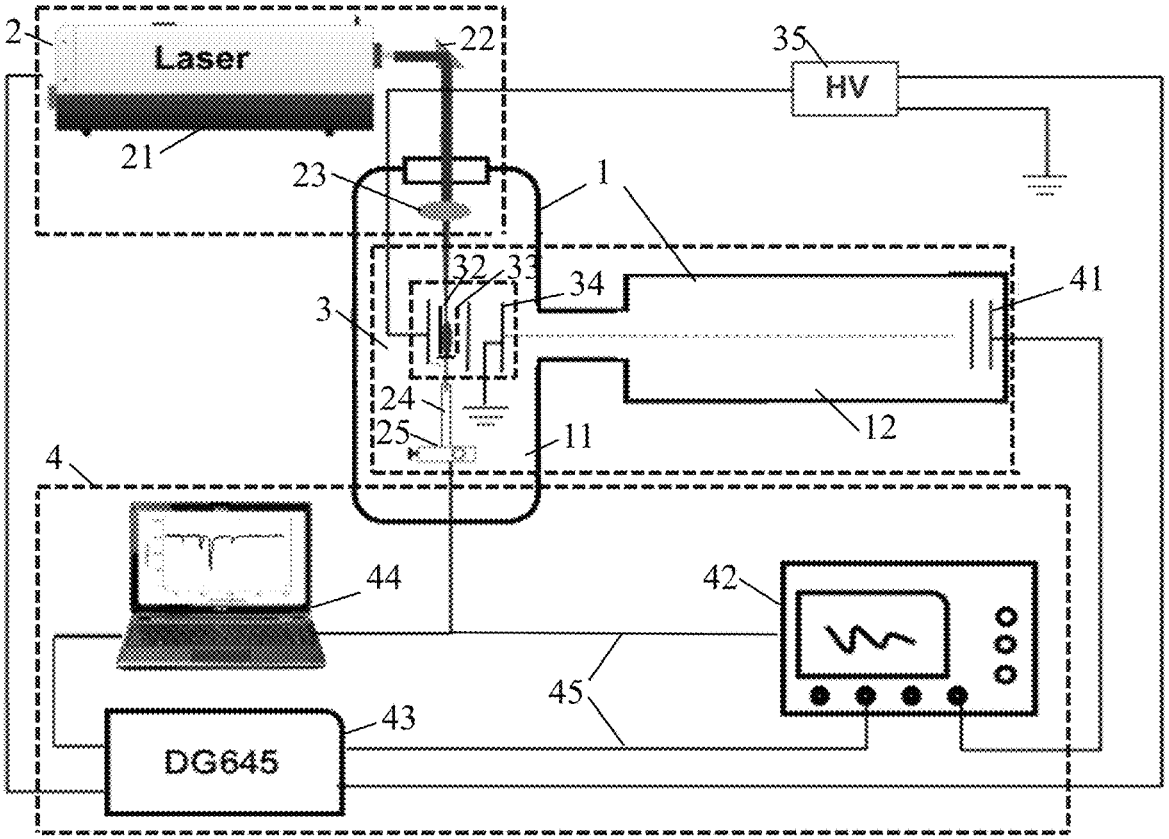
FIG. 1 is a structural schematic diagram of a mass spectrum resolution device for measuring laser ablation ion species with improved time of flight mass spectrometry provided by the present invention.

FIG. 1 is a structural schematic diagram of a mass spectrum resolution device for measuring laser ablation ion species with improved time of flight mass spectrometry provided by the present invention. As shown in FIG. 1, a mass spectrum resolution device for measuring laser ablation ion species with improved time of flight mass spectrometry provided by the embodiments of the present invention, comprises: a vacuum system unit 1, a plasma production unit 2, a particle restraint selection and separation unit 3, and a signal collection unit 4.

The vacuum system unit 1 is used to keep the whole time of flight mass spectrometer system at a certain vacuum degree so that the experimental results are not affected by external factors. The vacuum system unit 1 comprises a vacuum pulse extraction field chamber 11 and a vacuum fieldless drift chamber 12. A butterfly valve is arranged between the vacuum pulse extraction field chamber 11 and the vacuum fieldless drift chamber 12, and used to control the connection of the vacuum pulse extraction field chamber 11 and the vacuum fieldless drift chamber 12. The vacuum pulse extraction field chamber 11 and the vacuum fieldless drift chamber 12 are first pumped to a certain vacuum degree by a mechanical pump, and then pumped to a lower vacuum degree by a molecular pump so that the chambers are maintained at a vacuum degree that meets the experimental conditions.

The plasma production unit 2 is used to irradiate a sample to be detected so that the surface of the sample is irradiated by the laser to generate plasma. The plasma production unit 2 comprises a nanosecond pulse laser 21, a laser reflector 22, a laser focusing lens 23, a sample lifting target 24 and a rotating motor 25; the sample lifting target 24 is arranged on the shaft of the rotating motor 25; the laser generated by the nanosecond pulse laser 21 irradiates a sample placed on the sample lifting target 24 after passing through the laser reflector 22 and the laser focusing lens 23 in sequence; specifically, the laser emitted by the nanosecond pulse laser 21 is reflected and collimated by the laser reflector 22 and then is incident upon the laser focusing lens 23; the emergent light of the laser focusing lens 23 vertically irradiates the sample placed on the sample lifting target 24. The laser focusing lens 23 and the sample lifting target 24 are respectively arranged in the vacuum pulse extraction field chamber 11.

Figure 2:
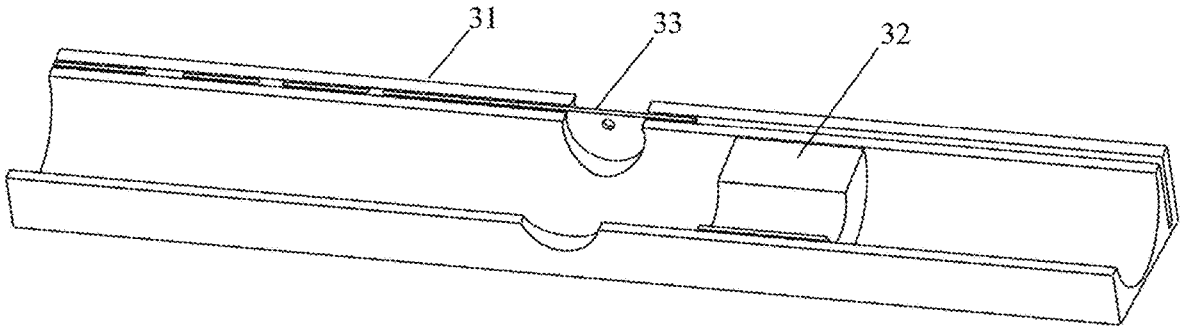
FIG. 2 is a structural schematic diagram of a section of a particle limit selector.
Figure 3:
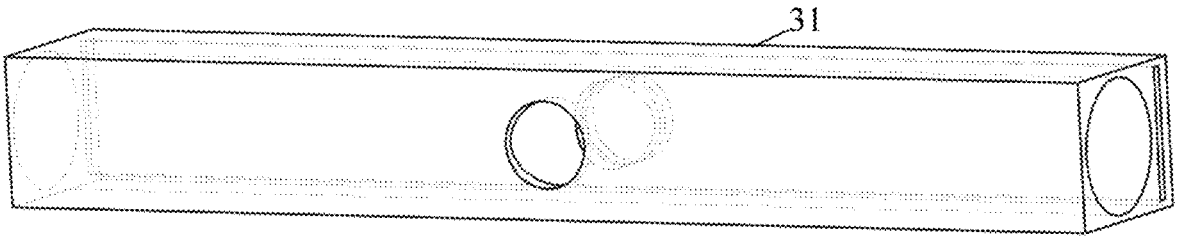
FIG. 3 is a structural schematic diagram of a restrainer lifting block.
Figure 4:
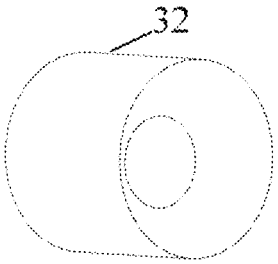
FIG. 4 is a structural schematic diagram of a restrainer.
Figure 5:
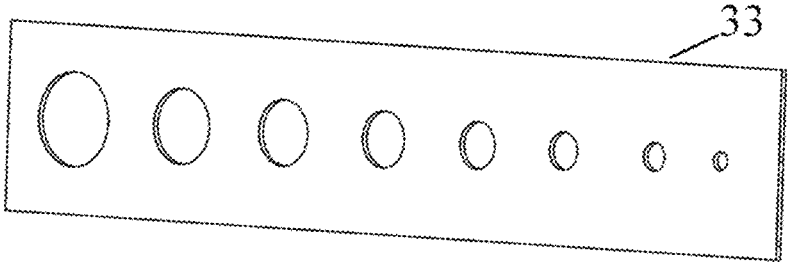
FIG. 5 is a structural schematic diagram of a restrainer selection baffle.

The particle restraint selection and separation unit 3 is used to restrain the plasma source and load the same energy to and introduce the selected ions within a certain spatial range into the vacuum fieldless drift chamber 12. The particle restraint selection and separation unit 3 comprises a particle limit selector and a plurality of ion pulse accelerated electrode plates 34. FIG. 2 is a structural schematic diagram of a section of a particle limit selector. As shown in FIG. 2, the particle limit selector comprises a restrainer lifting block 31, a restrainer 32 and a restrainer selection baffle 33. FIG. 3 is a structural schematic diagram of a restrainer lifting block; FIG. 4 is a structural schematic diagram of a restrainer; FIG. 5 is a structural schematic diagram of a restrainer selection baffle. As shown in FIG. 3-5, a through hole is formed in the restrainer lifting block 31; a plurality of circular holes with different apertures are formed in the restrainer selection baffle 33, and the restrainer 32 and the restrainer selection baffle 33 are both arranged in the restrainer lifting block 31; and the restrainer 32 and the restrainer selection baffle 33 can move in the restrainer lifting block 31, the movement of the restrainer 32 and the restrainer selection baffle 33 can be respectively realized by a stepping motor, and the restrainer 32 and the restrainer selection baffle 33 realize the restraint and selection in two different directions. The target circular hole and the through hole of the restrainer lifting block 31 are located in appropriate positions by the movement of the restrainer selection baffle 33, the plasma within the corresponding range can pass by adjusting the size of the aperture, and the central positions of all the holes are in a straight line. The ion pulse accelerated electrode plates 34 are arranged in the direction parallel to the axis of the vacuum pulse extraction field chamber 11 and are axially parallel to the restrainer lifting block 31. The ion pulse accelerated electrode plates 34 and the restrainer lifting block 31 are both perpendicular to the axial direction of the vacuum fieldless drift chamber 12. The ion pulse accelerated electrode plates 34 are connected with a high voltage pulse module 35, and the high voltage pulse module 35 can provide pulse voltage for the ion pulse accelerated electrode plates 34. The particle limit selector and the ion pulse accelerated electrode plates 34 are respectively arranged in the vacuum pulse extraction field chamber 11; and the particle limit selector is arranged between the two adjacent ion pulse accelerated electrode plates 34 on the utmost front end. For example, the number of the ion pulse accelerated electrode plates 34 is four; the first ion pulse accelerated electrode plate is fixed on one side of the restrainer lifting block 31, and the second, third and fourth ion pulse accelerated electrode plates are arranged on the other side of the restrainer lifting block 31 in sequence.

The signal collection unit 4 is used to detect signals of the arrival time of positive ions which pass through the pulse accelerating field and separate from each other in the fieldless drift area, and to transmit the signals to the computer as digital waveform data after synchronous collection. The signal collection unit 4, comprises a microchannel plate ion detector 41, an oscilloscope 42, a time sequence pulse digital delay generator 43, a computer 44 and a signal transmission line 45; the microchannel plate of the microchannel plate ion detector 41 is vertically arranged on the tail end of the vacuum fieldless drift chamber 12, and has the center in the same straight line as the center of the restrainer selection baffle 33; and the microchannel plate ion detector 41 is in signal connection with the oscilloscope 42, the nanosecond pulse laser 21, the high voltage pulse module 35 and the oscilloscope 42 are respectively connected with the time sequence pulse digital delay generator 43 through the signal transmission line 45, and the time sequence pulse digital delay generator 43 and the computer 44 are connected through the signal transmission line 45. The model of the time sequence pulse digital delay generator 43 is DG645.

For the time of flight mass spectrometer for improving the mass measurement resolution of ion species in laser ablation plasma provided by the present invention, first, a sample is placed on the sample lifting target 24 fixed to the rotating motor 25, the vacuum chambers are closed, the mass spectrometer is ensured to be in a sealed state, and the vacuum pulse extraction field chamber 11 and the vacuum fieldless drift chamber 12 are pumped to a vacuum degree of below $4.5\times10^{-4}$ pa by the molecular pump after being pumped to a certain vacuum degree by the mechanical pump; then the butterfly valve is opened to communicate the vacuum pulse extraction field chamber 11 and the vacuum fieldless drift chamber 12 to keep the same vacuum degree; after the vacuum degree meets the experimental requirements, the power supply of the microchannel plate ion detector 41 is loaded to the specified voltage; various parameters required by the experiment are set through the computer 44, wherein the experiment parameters include the position of the restrainer 32, the range of the restrainer selection baffle 33 for spatial range selection, the gate width and delay of the high voltage pulse module 35 and the microchannel plate ion detector 41, the voltage of the ion pulse accelerated electrode plates 34 and the like; and the obtained time of flight mass spectrum data is transferred from the microchannel plate ion detector 41 to the oscilloscope 42 through the signal transmission line 45 for display and then transferred to the computer 44 by the oscilloscope 42 through the signal transmission line 45 for transformation and storage.

The operating principle of the mass spectrum resolution device for measuring laser ablation ion species with improved time of flight mass spectrometry provided by the embodiments of the present invention is: the target material is placed in the particle limit selector in the vacuum extraction field chamber of the time of flight mass spectrometer, the light path of the laser is adjusted and collimated to make the laser introduced into the vacuum pulse extraction field chamber perpendicularly to the target material, and the through hole range of the restrainer baffle that meets the experimental assumption is selected. The digital delay pulse generator DG645 is used to set the time sequence and gate width of the laser, the pulse electric field and the microchannel plate ion detector; after the laser ablation target material generates plasma, the plasma restrainer is used to limit the lateral velocity of the plasma perpendicular to the isometric direction, and the ions only with a specific angle and speed are extracted from small holes and accelerated through the time sequence control of the pulse accelerating field and the selection of the spatial range selection baffle; and after the ions that meet the specific conditions enter the vacuum fieldless drift chamber, the corresponding species information is given according to different charge-to-mass ratios of ions and different time of arrival at the ion detector. After being displayed in real time and collected synchronously by the oscilloscope, the signals received by the ion detector are finally transmitted to the computer as digitized waveform data, and then analyzed and processed by the computer to determine the spatial and temporal evolution information of the plasma generated by laser ablation and the species distribution in the plasma.

The wall of the mass spectrum resolution device for measuring laser ablation ion species with improved time of flight mass spectrometry provided by the embodiments of the present invention can limit the free diffusion of particles in the plasma generated by laser ablation, and can block the plasma in the undesired detection area so that the range of extracted particles is undisturbed. Compared with the conventional mass spectrometers with other velocity distribution, the device can select the position and range of the extracted plasma according to the experimental requirements, and solve the measurement problem of too large broadening during detection of spatial and temporal distribution and initial lateral velocity of different species in samples in the existing laser ablation time of flight mass spectrometry so that the half-peak width of the spectrum is reduced and the resolution is greatly improved. The data provides experimental data verification for researching the temporal distribution and the lateral particle velocity measurement of the species during the expansion of the laser ablation plasma, which is conducive to deepening the research on the physical mechanism of the laser ablation of the plasma, improves the resolution of the time of flight mass spectrum and has a better practical effect.

Finally, it should be noted that the above embodiments are only used for describing the technical solution of the present invention rather than limiting the present invention; and although the present invention is described in detail by referring to the above embodiments, those ordinary skilled in the art should understand that: the amendments to the technical solution recorded in each of the above embodiments or the equivalent replacements for part of or all the technical features therein do not enable the essence of the corresponding technical solution to depart from the scope of the technical solution of various embodiments of the present invention.

The invention claimed is:

1. A mass spectrum resolution device for measuring laser ablation ion species with improved time of flight mass spectrometry, comprising: a vacuum system unit, a plasma production unit, and a particle restraint selection and separation unit, wherein:

the vacuum system unit comprises a vacuum pulse extraction field chamber and a vacuum fieldless drift chamber;

the plasma production unit comprises a nanosecond pulse laser, a laser reflector, a laser focusing lens, a sample lifting target and a rotating motor; the sample lifting target is arranged on the shaft of the rotating motor; the laser generated by the nanosecond pulse laser irradiates a sample placed on the sample lifting target after passing through the laser reflector and the laser focusing lens in sequence; and the laser focusing lens and the sample lifting target are respectively arranged in the vacuum pulse extraction field chamber;

the particle restraint selection and separation unit comprises a particle limit selector and a plurality of ion pulse accelerated electrode plates; the particle limit selector comprises a restrainer lifting block, a restrainer and a restrainer selection baffle; a through hole is formed in the restrainer lifting block; a plurality of circular holes with different apertures are formed in the restrainer selection baffle, and the restrainer and the restrainer selection baffle are both arranged in the restrainer lifting block; the restrainer and the restrainer selection baffle can move in the restrainer lifting block; the ion pulse accelerated electrode plates are arranged in the advance direction of particles and are axially parallel to the restrainer lifting block; the particle limit selector and the ion pulse accelerated electrode plates are respectively arranged in the vacuum pulse extraction field chamber; and the particle limit selector is arranged between the two adjacent ion pulse accelerated electrode plates on the utmost front end.

2. The mass spectrum resolution device for measuring laser ablation ion species with improved time of flight mass spectrometry according to claim 1, further comprising a signal collection unit;

the signal collection unit comprises a microchannel plate ion detector, an oscilloscope, a time sequence pulse digital delay generator, a computer and a signal transmission line;

the microchannel plate ion detector is arranged on the tail end of the vacuum fieldless drift chamber; and the microchannel plate ion detector is in signal connection with the oscilloscope, and the oscilloscope is respectively in signal connection with the time sequence pulse digital delay generator and the computer through the signal transmission line.

3. The mass spectrum resolution device for measuring laser ablation ion species with improved time of flight mass spectrometry according to claim 1, wherein a butterfly valve is arranged between the vacuum pulse extraction field chamber and the vacuum fieldless drift chamber, and used to control the connection of the vacuum pulse extraction field chamber and the vacuum fieldless drift chamber.

4. The mass spectrum resolution device for measuring laser ablation ion species with improved time of flight mass spectrometry according to claim 1, wherein the ion pulse accelerated electrode plates are connected with a high voltage pulse module.

5. The mass spectrum resolution device for measuring laser ablation ion species with improved time of flight mass spectrometry according to claim 1, wherein the number of the ion pulse accelerated electrode plates is four;

the first ion pulse accelerated electrode plate is fixed on one side of the restrainer lifting block, and the second, third and fourth ion pulse accelerated electrode plates are arranged on the other side of the restrainer lifting block in sequence.

* * * * *